US006592473B2

(12) United States Patent
McDonald et al.

(10) Patent No.: US 6,592,473 B2
(45) Date of Patent: Jul. 15, 2003

(54) APPARATUS AND METHOD FOR IMPROVING THE PLAYING OF GOLF

(76) Inventors: Garth R. McDonald, 13612 Jarrettsville Pike, Phoenix, MD (US) 21131; Rachael D. Breza, 420 Woodbine Ave., Towson, MD (US) 21204; Iain G. McDonald, 2264 Hwy. 15-501, Carthage, NC (US) 28327

( * ) Notice: Subject to any disclaimer, the term of this patent is extended or adjusted under 35 U.S.C. 154(b) by 0 days.

(21) Appl. No.: 09/842,439

(22) Filed: Apr. 26, 2001

(65) Prior Publication Data

US 2003/0017890 A1 Jan. 23, 2003

(51) Int. Cl.[7] ..... A63B 67/02
(52) U.S. Cl. ..... 473/407
(58) Field of Search ..... 473/150, 171, 473/173, 176, 404, 407, 409; 273/108.2; 463/42

(56) References Cited

U.S. PATENT DOCUMENTS

| | | | | | |
|---|---|---|---|---|---|
| 4,136,394 | A | | 1/1979 | Jones et al. | 364/561 |
| 4,331,425 | A | | 5/1982 | Davis, Jr. | 434/252 |
| 4,783,071 | A | * | 11/1988 | Tattershall | 273/32 |
| 4,815,020 | A | | 3/1989 | Cormier | 364/709.11 |
| 4,926,161 | A | | 5/1990 | Capp | 340/572 |
| 5,013,070 | A | | 5/1991 | Maude, Sr. | 283/49 |
| 5,044,634 | A | * | 9/1991 | Dudley | 273/32 R |
| 5,095,430 | A | | 3/1992 | Bonito et al. | 364/410 |
| 5,097,416 | A | | 3/1992 | Matthews | 364/410 |
| 5,245,537 | A | | 9/1993 | Barber | 364/410 |
| 5,283,733 | A | | 2/1994 | Colley | 364/411 |
| 5,284,340 | A | | 2/1994 | Laakso | 273/32 H |
| 5,294,110 | A | | 3/1994 | Jenkins et al. | 273/32 H |
| 5,319,548 | A | | 6/1994 | Germain | 364/410 |
| 5,324,028 | A | | 6/1994 | Luna | 273/32 R |
| 5,364,093 | A | | 11/1994 | Huston et al. | 273/32 R |
| 5,403,001 | A | | 4/1995 | Skorpinski | 273/32 H |
| 5,438,518 | A | | 8/1995 | Bianco et al. | 364/460 |
| 5,558,333 | A | | 9/1996 | Kelson et al. | 473/131 |
| 5,664,880 | A | * | 9/1997 | Johnson et al. | 473/407 |
| 5,685,786 | A | | 11/1997 | Dudley | 473/407 |
| 5,797,809 | A | | 8/1998 | Hyuga | 473/407 |
| 5,873,797 | A | | 2/1999 | Garn | 473/407 |
| 6,024,655 | A | | 2/2000 | Coffee | 473/407 |
| 6,027,417 | A | * | 2/2000 | Zoretic | 473/407 |
| 6,171,199 | B1 | * | 1/2001 | Cohodas | 473/131 |
| 6,296,579 | B1 | * | 10/2001 | Robinson | 473/407 |
| 2002/0049101 | A1 | * | 4/2002 | Robinson | 473/407 |

OTHER PUBLICATIONS

Laminated card of Mansion Ridge golf course showing 6 pin locations on each of the 18 greens on the course. no date.*

* cited by examiner

*Primary Examiner*—Thomas N. Moulis
(74) *Attorney, Agent, or Firm*—Armstrong, Westerman & Hattori, LLP

(57) ABSTRACT

A color-coded "user friendly" chart or display is provided for each putting green on a golf course, showing respective "extreme", "hazard", regulation" and "optimal" zones, respectively, and the chart or display may be changed easily and quickly and on a daily basis, if desired, whenever conditions on the putting green (such as pin location) are changed.

61 Claims, 8 Drawing Sheets

(2 of 8 Drawing Sheet(s) Filed in Color)

LEMON PATTERN

PUTT CHARACTERISTICS

2 STRAIGHT UPHILL R→L
3 STRAIGHT DOWNHILL L→R
4 UPHILL BREAKING R→L
5 UPHILL BREAKING L→R
6 SIDE HILL BREAKING R→L
7 SIDE HILL BREAKING L→R
8 DOWNHILL BREAKING R→L
9 DOWNHILL BREAKING L→R

COMPLEX BREAKING PATTERN

10 OVERALL FLAT
11 OVERALL UPHILL
12 OVERALL DOWNHILL

APPARATUS AND METHOD FOR IMPROVING THE PLAYING OF GOLF

FIELD OF THE INVENTION

The present invention describes an improved apparatus and method for playing golf. More specifically, the invention describes a dynamic, evidence-based, color-coded apparatus and method that accurately and pictorially represents the degree of difficulty in completing the hole from all positions on the putting green. The invention accommodates unique daily changes in the condition of the putting greens, such as relocation of the respective pins, thus improving the planning of approach shots to the respective putting greens and thereby reducing putting score on each putting green.

BACKGROUND OF THE INVENTION

Golf is a popular and challenging sport. The number of courses is increasing rapidly in the United States and throughout the world.

The objective in golf is to complete the round of usually 18 holes in as few strokes as possible. A regulation golf course is a par 72 and is normally comprised of four par 3's, four par 5's, and ten par 4's. Thus there are 18 tee shots, 18 fairway shots and 36 putts allocated to par. Furthermore, in a round of golf, about half of the strokes occur either on the putting green or in its immediate vicinity, and approximately 80% of the strokes over par occur within about 100 yards of the pin. For this reason the short game, and especially putting, are vitally important to the score.

Shot selection and shot execution define the game of golf, and the players appreciate any information about the course that helps them with shot selection. Unfortunately, however, that information is not readily available. On relatively inexpensive golf courses, there may be just a pin with a flag to indicate the position of the hole on the putting green. On average private courses, there may be differently colored flags to identify the front, middle and back thirds of a putting green. On resort courses, cards or booklets may provide more detailed (but static) information. Upgraded courses (employing caddies) provide daily pin placement sheets, but these only show the dimensions of the putting green.

More precise information is available to the professional golfer than to the amateur golfer Professional golfers engage in several practice rounds prior to tournaments and employ caddies to study courses. Professional golfers do this research in order to be armed with as much knowledge of the course as possible. This information helps the professional golfer plan to land a ball on a putting green in a location that will likely result in an optimal putting score.

One putt per green is an optimal score. Two putts per green is a regulation score, while three or more putts per green is a sub-optimal score. Where a golfer putts from on a putting green is important because it determines the likelihood of making that putt or subsequent putts thus affecting the putting score. The most significant factors that influence the likelihood of the number of putts per putting green include: (a) distance of the ball from the pin, (b) putting green topography, (c) the severity of the slope, (d) the speed of the putting green, (e) the skill level of the player, (f) the physical condition of the putting green, and (g) the grass type and grain. These generally known factors are detailed in *Dave Pelz's Putting Bible*, published by Doubleday, 2000 and *Dave Pelz's Shortgame Bible*, published by Broadway Books, 1999. These two works are herein incorporated by reference.

The pin placement on the putting green is changed frequently to effect even wear on the putting green and to present the golfer with a variety of different challenges. Changes in pin placement can dramatically alter the character of a golf course and hence significantly alter the likely score. Although on any given day, on any given putting green, the topography, green speed, condition, grass type and grain may be constant, their relationship to different pin positions dramatically affects the difficulty the putting green represents to the player. The depiction of a putting green's unique playability as determined by daily conditions is extremely useful information to the golfer in planning.the approach shot. The Putting Green Hazard Function (P.G.H.F.) describes the changing putting difficulty of all locations on a putting green and enables the clear depiction of this information to the golfer.

The P.G.H.F. defines the relationship between any point on the putting green and the current pin position. The P.G.H.F. is an evidenced-based mathematical equation that represents the number of putts that is likely to be required to hole out the ball from each position on the putting green.

In making an approach shot to the putting green, the object is to stop the ball, preferably in the optimal zone, or at least in the regulation zone on the putting green and avoid the hazard zone. Where these zones are located may not be obvious, especially on an unfamiliar course. Pin placements can be quite seductive and present a deceptive lure that is recognized only by those with local-knowledge. Thus, there is a need for a dynamic presentation of the putting greens on a golf course.

DESCRIPTION OF THE PRIOR ART

In the prior art, of which I am aware, there have been numerous attempts to utilize available technologies to improve one's golf game; but these attempts, for one reason or another, are not applicable to the problem at hand (namely, the Putting Green Hazard Function (P.G.H.F.)) or else are complicated and unwieldy. The majority of prior art provides merely a static presentation, not a dynamic presentation, of the putting green. Additionally, some of the prior art would be considered "illegal" under the standards set forth by the United States Golf Association (USGA) for both the professionals and the amateurs.

For example, Davis, Jr. U.S. Pat. No. 4,331,425 merely discloses a combination golf scorecard and hole information guide having front and rear cover pages and a plurality of intermediate pages folded among a vertical centerline and bound together. Each of the intermediate pages includes an enlarged depiction of a hole on the golf course, and the pages and holes are arranged in a numerical succession. The interior surface of the rear cover includes an area for recording the score. The intermediate pages include cut-outs in the respective upper right-hand corners. When the intermediate pages overlie the inner surface of the rear cover, the score recording area is accessible for recording a score thereon.

Cormier No. U.S. Pat. No. 4,815,020 discloses a hand-held device provided with a keyboard and display. The purpose is to determine the remaining distance to the putting green and for selecting an appropriate club.

Maude, Sr. U.S. Pat. No. 5,013,070 discloses a golf scorecard that assists the player in evaluating the characteristics of the putting greens on a golf course. In addition to the score, the card includes a graphic illustration of each of the holes and provides indicia indicating the direction of the grain of the grass on each putting green.

Bonito et al U.S. Pat. No. 5,095,430 disclose a golf cart computer for installation in a golf cart. The computer contains a display screen for showing graphically the details and features of each hole of a golf course.

Barber U.S. Pat. No. 5,245,537 discloses a golf distance tracking, club selection and player performance statistical device having a portable movement measurer connected to a microprocessor. A database is provided on a non-portable computer system that contains reference coordinates for each hole on the golf course and every significant hazard.

Laakov U.S. Pat. No. 5,284,340 discloses a golf scorecard and playing booklet. This booklet has at least ten sheets that are folded together, accordion style. A front cover is provided so that when the sheets are folded, they form a booklet listing the name and identity of the golf course. A scorecard for keeping score is provided on the second sheet. Eighteen additional sides of the remaining sheets contain a depiction and description of the holes of the golf course and tips on how to play the hole. An additional sheet can be provided for advertising and promotional purposes.

Jenkins et al U.S. Pat. No. 5,294,110 discloses an instrument for reading and recording atmospheric pressure, optical reading and manual recording of both the distance from the current ball position to the pin, the vertical distance of the current ball position above or below the pin, and optically estimating the recording of the forward slope and the sideways slope as well as the manual estimating of turf conditions at the ball positions.

Huston et al U.S. Pat. No. 5,364,093 discloses a method for determining the approximate distance of a golf ball to the cup using a global positioning satellite system.

Hyuga U.S. Pat. No. 5,797,809 discloses a golf course guidance device and the like to be used for giving guidance information about the holes and putting greens on a golf course. The holes and the putting greens on a golf course.are respectively divided into small cells. For each hole, the location of a golf course guidance device is detected by a sub unit location detection means. By comparing the data from the cell corresponding to the location of the golf course guidance device, the data from within each cell (which is read from a hole cell data table of a hole cell data storage means) the location and other data is displayed on a liquid crystal display, together with the distance and the direction to the center of the putting green. Further, the aforementioned distance is adjusted with the direction and speed of wind being taken into consideration.

Skorpinski U.S. Pat. No. 5,403,001 discloses a putting aid device for reading a putting green by measuring the direction and slope on a green and indicating to the golfer a particular ball lie relative to a ball hole. This putting aid device can be used to produce a putting variance chart of the conditions of a putting green, and the putting green chart eliminates the need to use the putting aid device immediately prior to each putt. However, the methodology employed merely produces a static chart of the putting green; and this chart being static, is incomplete and inaccurate and hence misleading. Moreover, this is a putting aid, not an aid to an approach shot.

With respect to color (and the prior art currently being used on a golf course, particularly by the pros) only the topographical maps are colored; namely, dark green for the valleys and light green for the crests.

Other prior art, of which I am aware, are as follows:

| Inventor(s) | Patent No. | Brief Description |
|---|---|---|
| Jones et al | 4,136,394 | a range finding measuring measuring distance to a putting green. |
| Cupp | 4,926,161 | a method of monitoring golf carts on a golf course. |
| Matthews | 5,097,416 | a system for monitoring the play of a golfer. |
| Colley | 5,283,733 | a computer-based scoring system |
| Germain | 5,319,548 | an alternative golf information system allowing retrospective analysis of performance, bets, etc. |
| Luna | 5,324,028 | a computer-based system of guiding golfers around a golf course. |
| Bianco et al | 5,438,518 | a portable distance finding system. |
| Kelson et al | 5,558,333 | a microcomputer to record shot locations and measure playing performance during a round of golf. A reference teaching aid. |
| Dudley | 5,685,786 | a golf cart computer-based golf information system and method. |
| Garn | 5,873,797 | a golf cart computerized golf navigation system. |
| Coffee | 6,024,655 | a matching golf navigation system. |

Aside from the legality or lack thereof, it should be noted that despite the extent and sophistication of the prior art, no one to date has come up with a practical, dynamic apparatus and method for readily indicating at least the relative hazard zones on each putting green and its immediate area proximate thereto, taking into account the daily local conditions, and employing a statistical methodology and analysis which is complete, evidenced based and standardized.

SUMMARY OF THE INVENTION

Accordingly, it is an object of the present invention to alleviate the disadvantages and deficiencies of the prior art by readily indicating at least the relative hazard zone on each putting green and its immediate proximity, and, preferably, the respective optimal, regulation and hazard zones for each putting green.

It is another object of the present invention to provide an improved apparatus and method which is dynamic, not static, and which readily changes the respective optimal, regulation and hazard zones in accordance with the changing daily conditions of the putting greens and, particularly, any relocation of the respective pins.

It is a further object of the present invention to provide color-coded information in a "user friendly" format or display, thereby reducing the advantage of local knowledge, making the game more equitable for individuals or team players, increasing the speed of play by directing the players away from time-consuming difficult positions, lowering scores and, in general, increasing the overall enjoyment of the came.

While not necessarily confined thereto, the present invention finds particular utility with respect to a golf course that includes a plurality of putting greens, each of which is provided with a pin indicating the hole location on the respective putting green, and wherein the pin location is changed from time to time.

In accordance with the teachings of the present invention, a preferred embodiment thereof is herein disclosed whereby a new color-coded display for each putting green is provided whenever the pin locations or other conditions are changed on the respective putting greens. These color-coded displays indicate at least a relative hazard (or "danger") zone for each putting green and the immediate proximity thereof Preferably, four primary zones are identified on the color-coded display, namely, optimal, regulation, hazard and extreme, respectively. The optimal zone may be represented by green, yellow for regulation; red for hazard; and dark red for extreme. The dark red zone is a likely 4 putt. The red zone is a likely 3 putt. The yellow zone is a likely 2 putt. The green zone is a likely 1 putt. Moreover, the hue or intensity of the respective color changes within each zone. For example, red may represent very dangerous while an orange may be used when approaching the yellow regulation zone, so that the colors tend to blend as in a rainbow.

Thus, the P.G.H.F. is depicted as a rainbow, whereby the colors are blended ranging from blue for the cup, and then to green, yellow and red as the hazard increases.

Viewed in another aspect, the present invention provides an improved method of playing the game of golf This improved method includes the step of providing an evidence-based, statistically-sound, color-coded, user-friendly, hand-held display for the respective putting greens on the golf course. This display is provided by an internet server via a wireless communication link to the hand-held display; and the display changes in accordance with changing conditions on the respective putting greens, thereby improving the approach shots to the respective putting greens. The changing conditions comprise the changing pin locations, putting green speed, player ability, and green conditions on the respective putting greens.

Further objects of the present invention are as follows:

1) To provide a valuable learning tool for use by the individual player or his or her instructor, thereby providing feedback for more efficient learning. Retrospective analysis of strokes played can distinguish poor course management from poor short iron game execution to poor putting. Many golfers do not correctly identify their weaknesses.

2) To serve as a caddy instructional tool, particularly for junior caddies, who are often less than ideally familiar themselves with the local hazards and consequences of various ball positions on the putting green presented by that day's course set-up.

3) To provide an aid to a golf tournament committee in setting up the course. Knowing the local conditions which prevail that day, will assist in selecting the pin placements, thereby leading to a more predictable event, reducing player complaints, and increasing the enjoyment of the game for both the participators and the spectators. [For example, an extremely difficult pin position on the $17^{th}$ hole at Valderrama (Spain) resulted in the redistribution of substantial prize money and an appearance of unfairness at the 2000 World Championship of Golf tournament.]

4) To provide a design aid to golf course architects, developers and owners. Putting greens which have been designed (but not yet built) can be evaluated for their Putting Green Hazard Function ("P.G.H.F.") or playability under a variety of different theoretical circumstances. The relationship between topography, putting greed speed, grass type, and pin position can be correlated. Combinations of these factors (producing unacceptable playability) can be readily identified and the putting green redesigned, thereby avoiding later unexpected (and costly) reconstruction. Further, the putting green design can be optimized for a variety of acceptable pin positions, thereby reducing wear and increasing overall efficiency in construction.

5) To provide a print-out sheet to serve as a souvenir memorializing a special round based on location of pin position, performance, company, or other factors.

6) To aid commentators and viewers of major televised golf tournaments to better understand the strategy of the tournament committee in setting up the course, the strategy of the players in shot placement, and the subsequent hazard yet faced by the respective contestant, either from the tee, fairway or when the ball is on the putting green.

7) To improve the current rating system by providing a refined standardized method of evaluating the daily variability effected by different putting green conditions, thereby offering a more equitable amateur handicap system.

8) To improve simulated golf games as well as golf video games. A color representation of the degree of difficulty would enable the player to understand the consequences of selecting particular putt force and line. The increased complexity and authenticity of this golf simulation package will add to the enjoyment of the video game experience.

9) To improve a golfer's play on the entire course—the inherent concept of the present invention may be extrapolated to every part of the golf course and not just the putting green.

These and other objects of the present invention will become apparent from a reading of the following specification taken in conjunction with the enclosed drawings.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

GENERAL DESCRIPTION OF THE PREFERRED EMBODIMENTS

Figure 1:
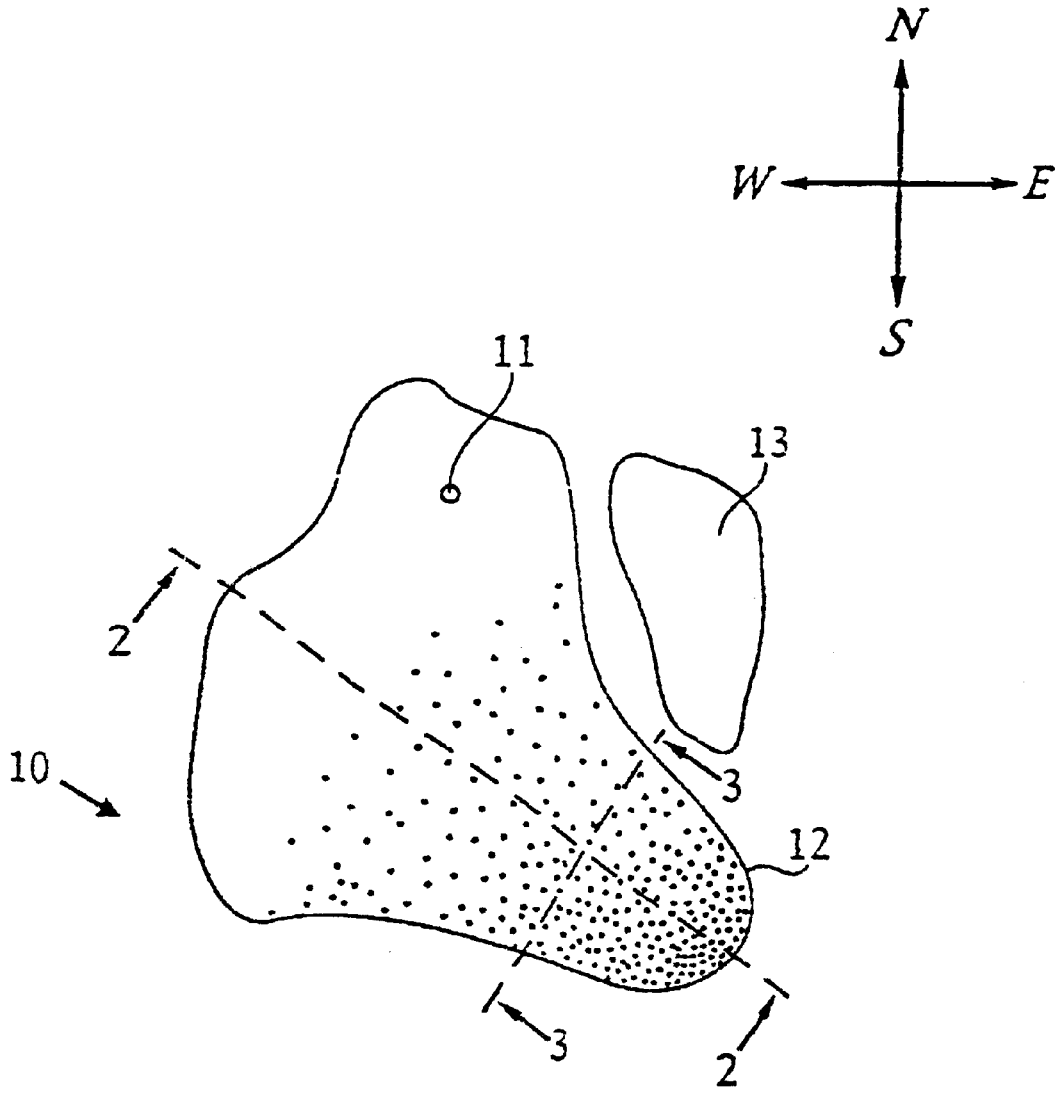
FIG. 1 shows a typical putting green with an adjacent bunker The stippling shows the topography of the putting green. The topography, of course, stays the same.
Figure 2:
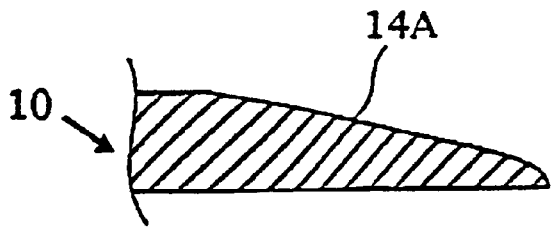
FIG. 2 is a cross-sectional view thereof, taken along the lines 2—2 of FIG. 1, and showing the downhill gradient of the putting green. This downhill gradient may be referred to as the "NW/SE" axis.
Figure 3:
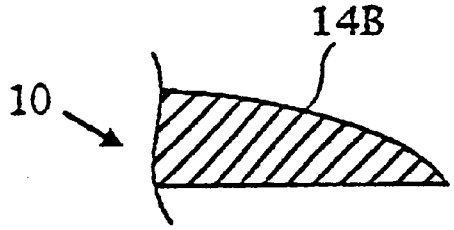
FIG. 3 is a further cross-sectional view thereof, taken along the lines 3—3 of FIG. 1, and showing the sidehill gradient of the putting green. This sidehill gradient may be referred to as the "NE/SW" axis.

With reference to FIGS. 1–3, a typical putting green 10 has a pin 11 defining the cup (not shown) on a typical golf course. The putting green 10 (and its proximity) are defined by a perimeter 12. Outside of the perimeter 12, is a bunker (or sand trap) 13. In the example of FIGS. 1–3, the slope of the putting green 10 consists of a downhill gradient 14*a* and a sidehill gradient 14*b*. In this particular example, downhill gradient 14*a* is on a NW/SE axis (as shown in FIG. 1) and the sidehill gradient 14*b* is on a NE/SW axis. These respective axes will rotate in accordance with changes in the pin location.

The configuration and topography of the putting green 10 is displayed graphically by stippling or contour lines or both. The graphic presentation may be a printed sheet, scorecard or else by computer monitor, such as a "Palm Pilot".

Figure 1A:
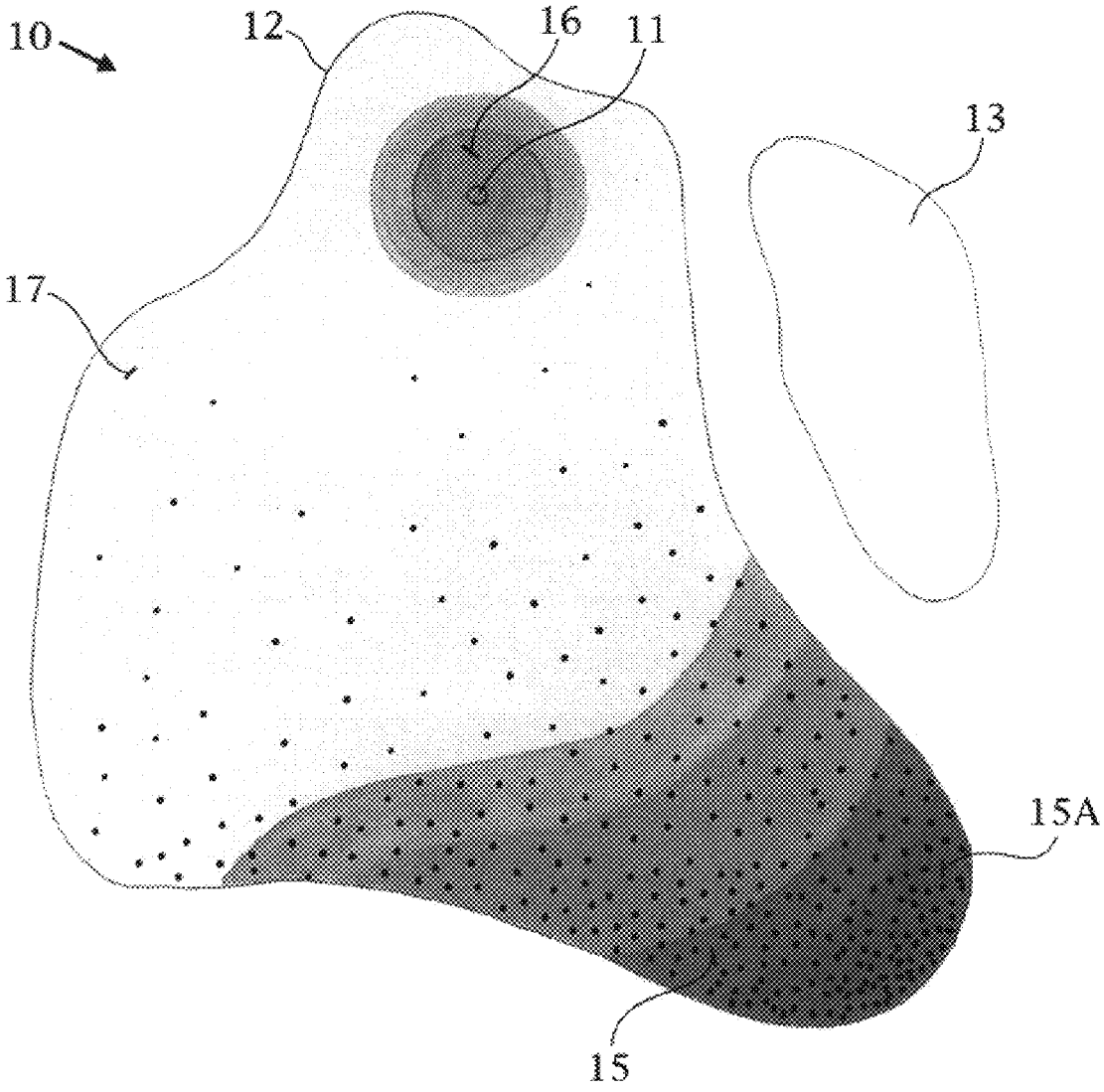
FIG. 1A is an enlarged portion of FIG. 1, showing the colors for the optimal, regulation, hazard and extreme zones, respectively, and further showing how these colors blend together as in a rainbow.
Figure 4B:
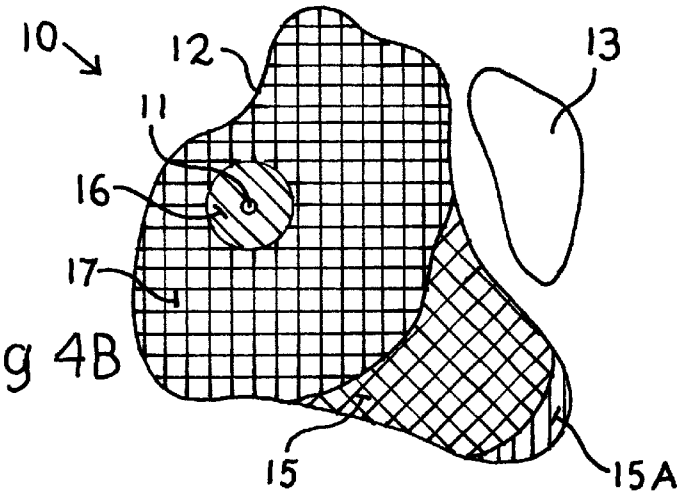
FIGS. 4A–4D illustrate, schematically, how the optimal, regulation and hazard zones, respectively, change on a particular green as the pin location on the putting green is changed. The optimal, regulation and hazard zones are non-hatched in green, yellow and red, respectively.
Figure 4D:
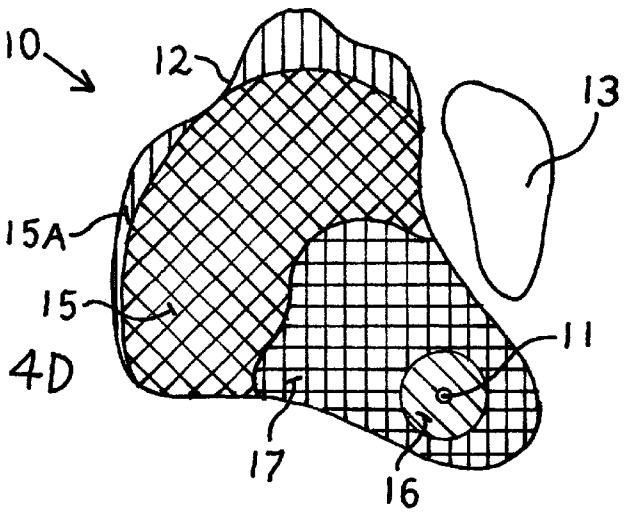
Figure 4A:
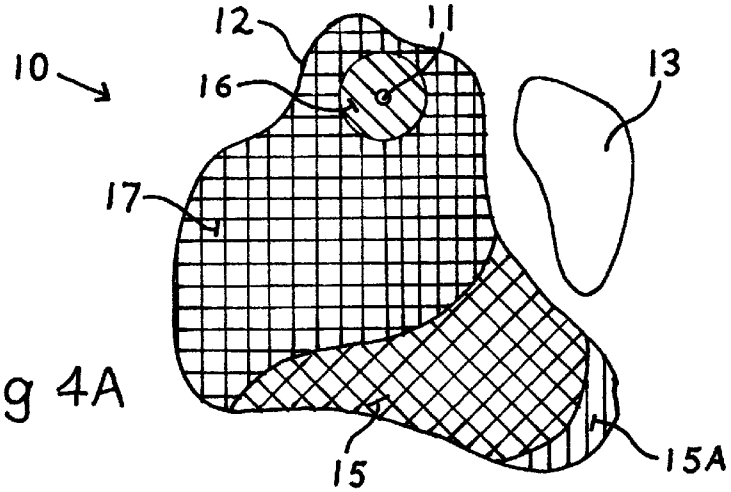
Figure 4C:
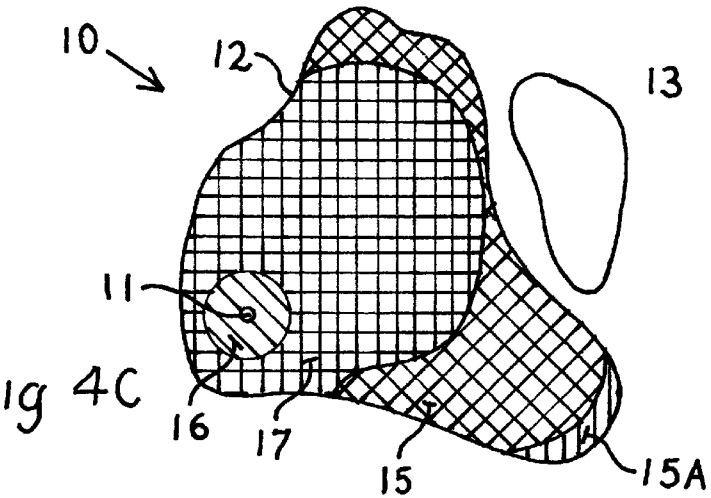
Figure 4E:
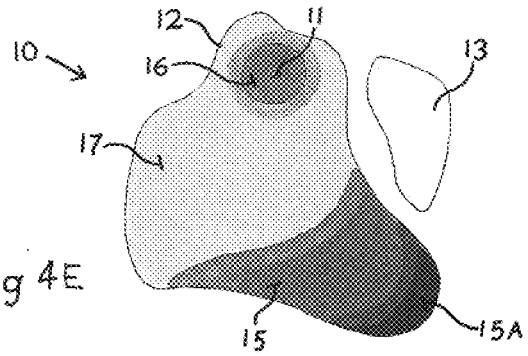
FIGS. 4E–4H correspond to FIGS. 4A–4D, respectively, but show the respective colors and how they blend as in a rainbow.
Figure 4F:
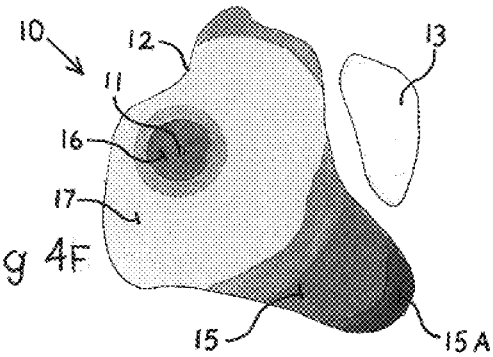
Figure 4G:
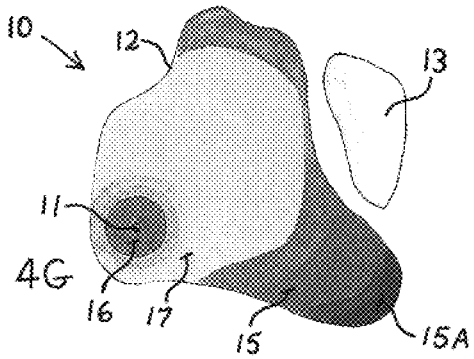
Figure 4H:
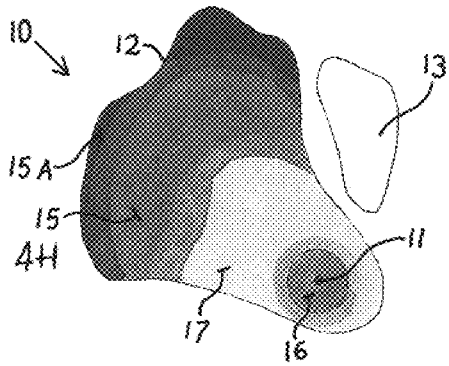

With reference to FIG. 1A and with further reference to FIGS. 4A–4D, the putting green 10 is organized by a mathematical formula into respective zones which are color-coded. For example, an "extreme" zone 15A may be shown in dark red, a "hazard" zone 15 in red, and an "optimal" zone 16 in green. Additionally, a "regulation" zone 17 (between the hazard zone 15 and optimal zone 16) may be shown in yellow. The pin 11 is always in blue.

Moreover, and as shown more clearly in FIG. 1A, the hue of each color changes in intensity; as for example, from a deep red (in the extreme zone 15A) to a red in the hazard zone 15 to an orange approaching the yellow regulation zone 17, and to a green representing the optimal zone 16 to a blue representing the pin 11, such that the colors blend together as in a rainbow.

Thus, the player has a "user friendly" display of the putting green 10 when making his or her approach shot, so that the player will ideally attempt to position the ball in the green optimal zone 16, but equally importantly will attempt to avoid the hazard zone 15 and, especially, the extreme zone 15A. The pin (blue) 11 is always in the (green) optimal zone 16.

Even more significantly, the present invention readily accommodates any changes in the putting green condition, especially the pin location. Depending upon the course, the pin location 11 changes on a daily basis.

Although the extreme, hazard, regulation and optimal zones 15A, 15, 16 and 17, respectively, on the putting green 10 are changed accordingly, nevertheless, these respective zones are presented in a "user friendly" manner that can be readily appreciated, not only by the players, but also by the caddies, instructors, golf course architects, tournament officials, those spectators provided with a Putting Green Hazard Function (PGHF) document, and the TV audience.

Figure 8:
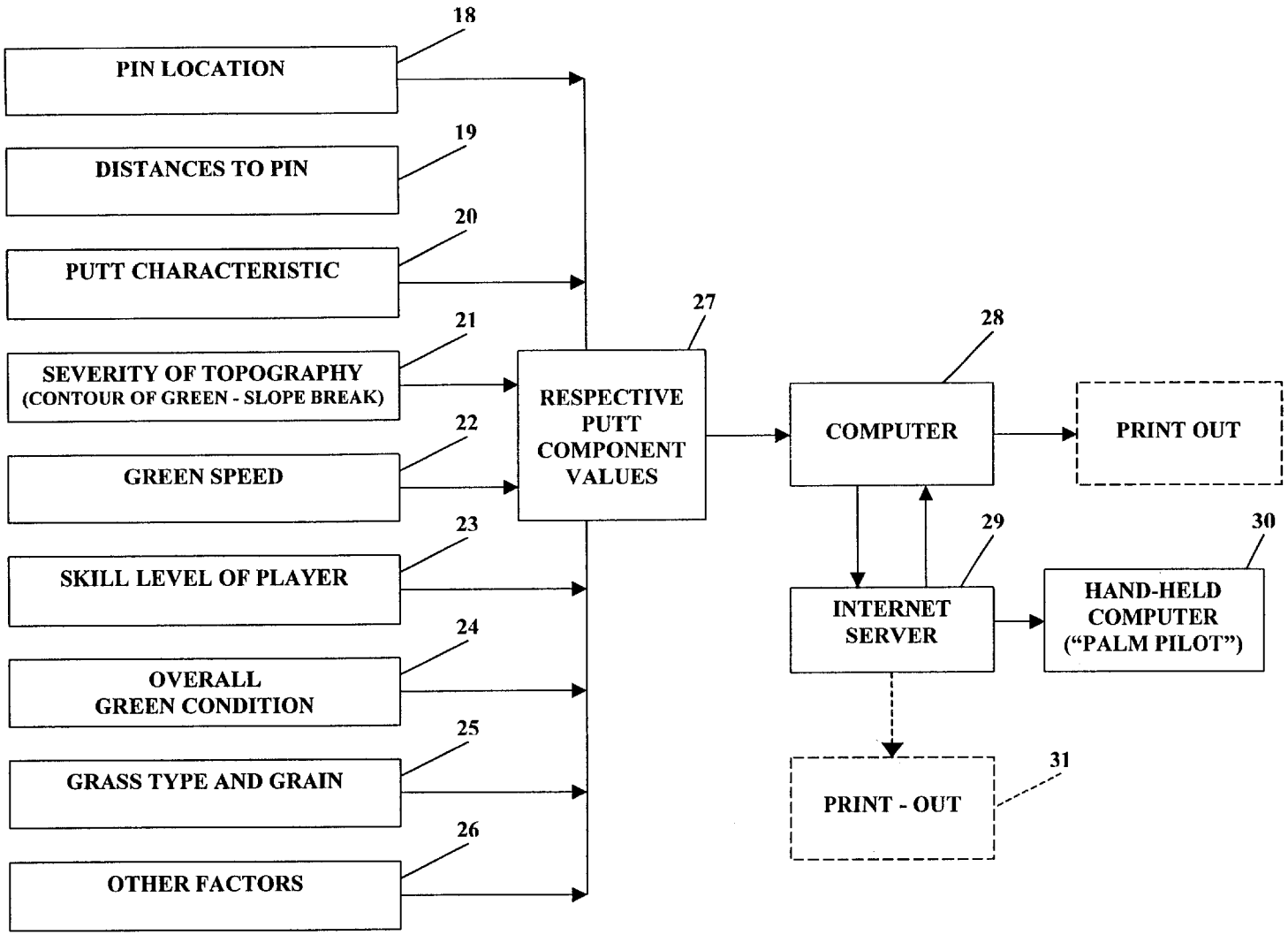
FIG. 8 is a schematic block diagram of the present invention, showing the various changing putting green conditions (and, in particular, the pin locations) and further showing the respective weighing factors fed into a computer for producing the desired user-friendly display.
Figure 4B:
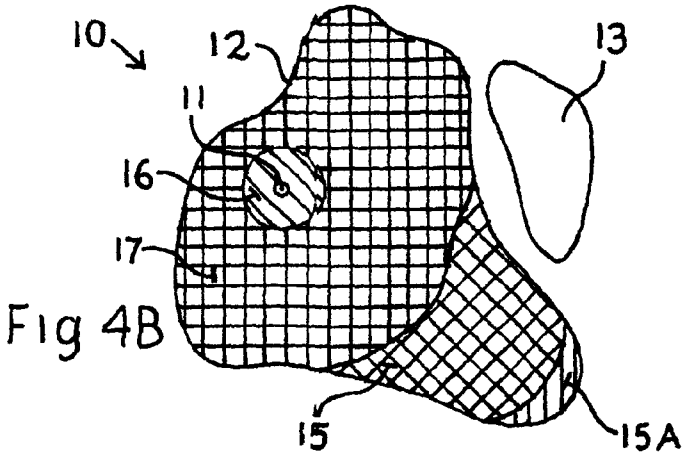
Figure 4D:
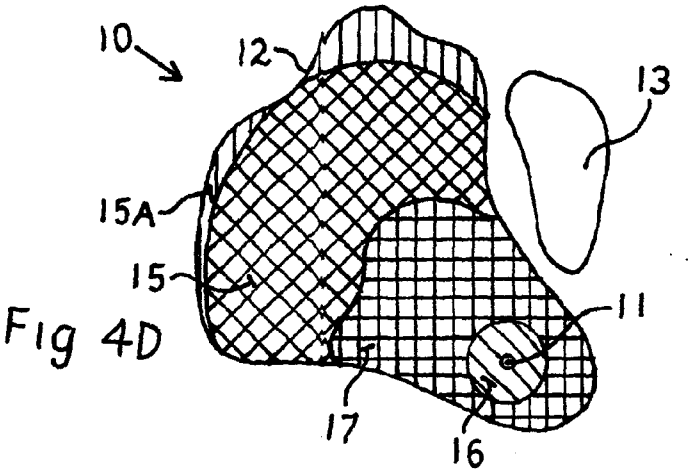
Figure 4A:
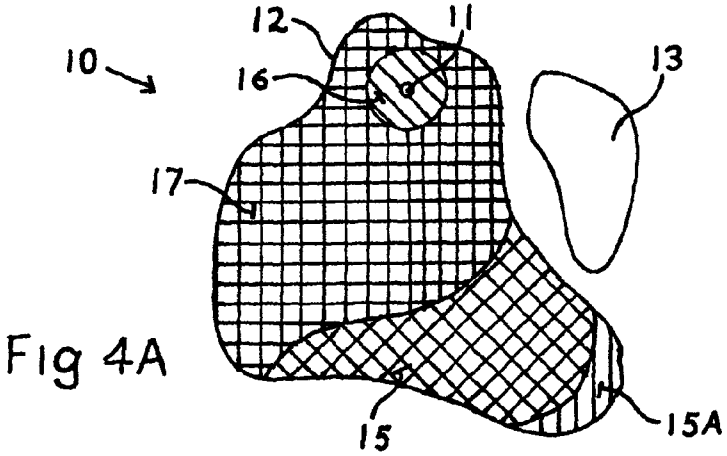
Figure 4C:
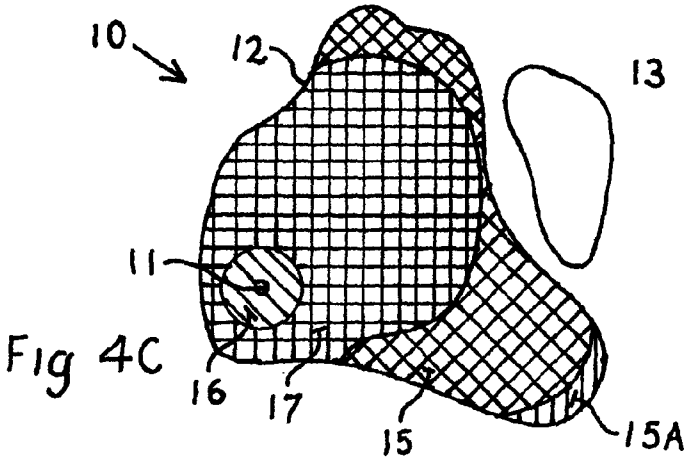
Figure 4F:
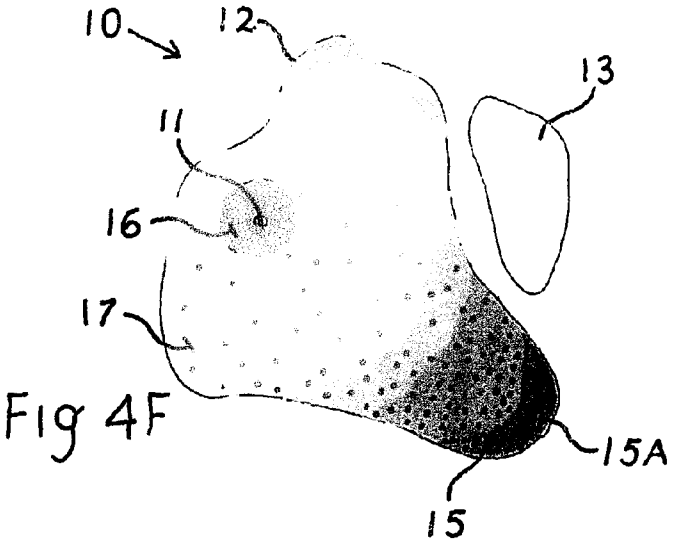
Figure 4H:
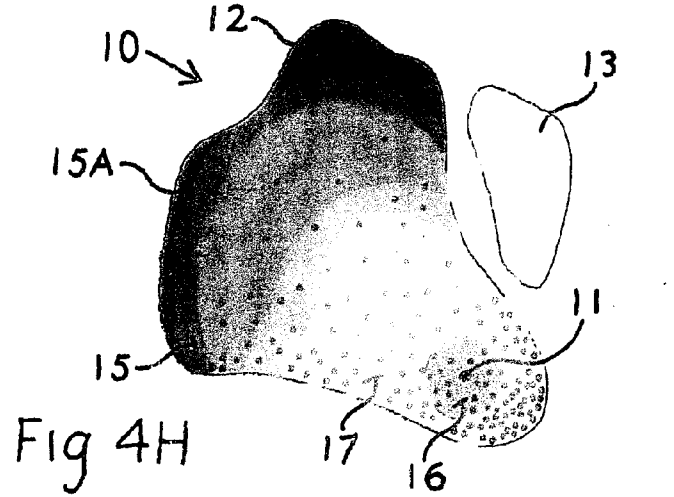
Figure 4E:
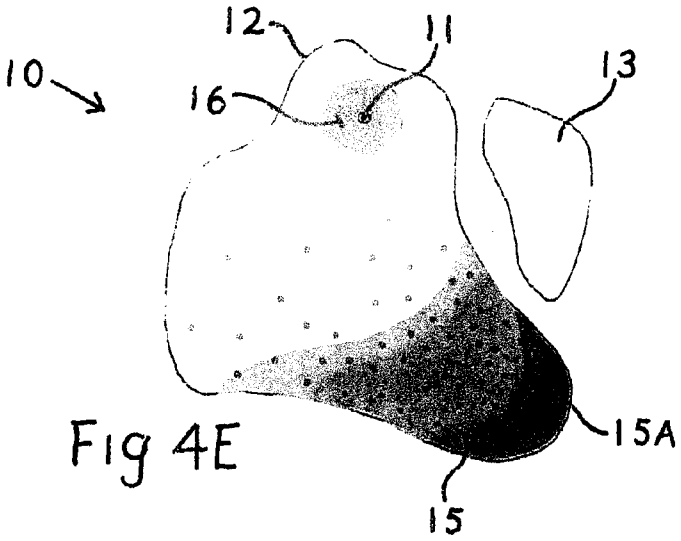
Figure 4G:
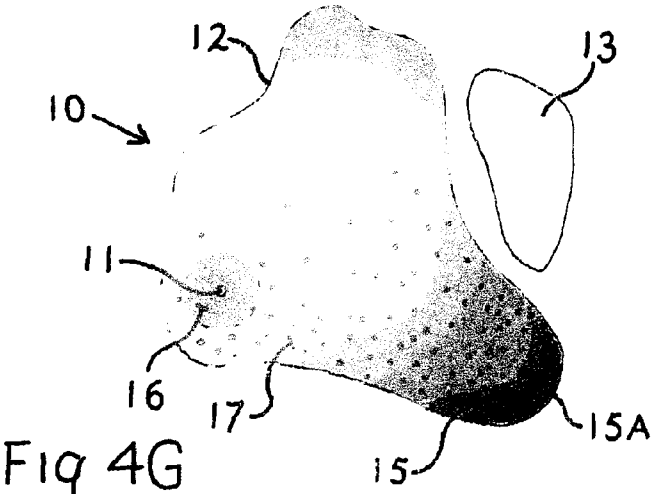

With respect to FIG. 8, the changing conditions on the putting green 10 (which are interrelated to the pin location 11) include the pin location 18, distance to the cup 19, putt characteristic 20, severity or break of the slope (contour of the green) 21, the putting green speed 22, the skill level of the player 23, the overall condition 24 of the putting green, the grass type and grain 25, and any other conditions 26 (e.g., wetness, etc.).

By a complex statistical analysis, empirical weighing factors 27 (based upon experience/observed data) are assigned to these conditions 18–25 and are inputted to a programmed computer 28. The computer 28 may cooperate with an internet server 29 to provide a color-coded visual display 30 held by the player. Alternatively, a print-out 31 may be provided (via the internet server 29 or directly from the computer 28) and made available daily at the pro shop for each green 10 on the golf course.

Figure 6:
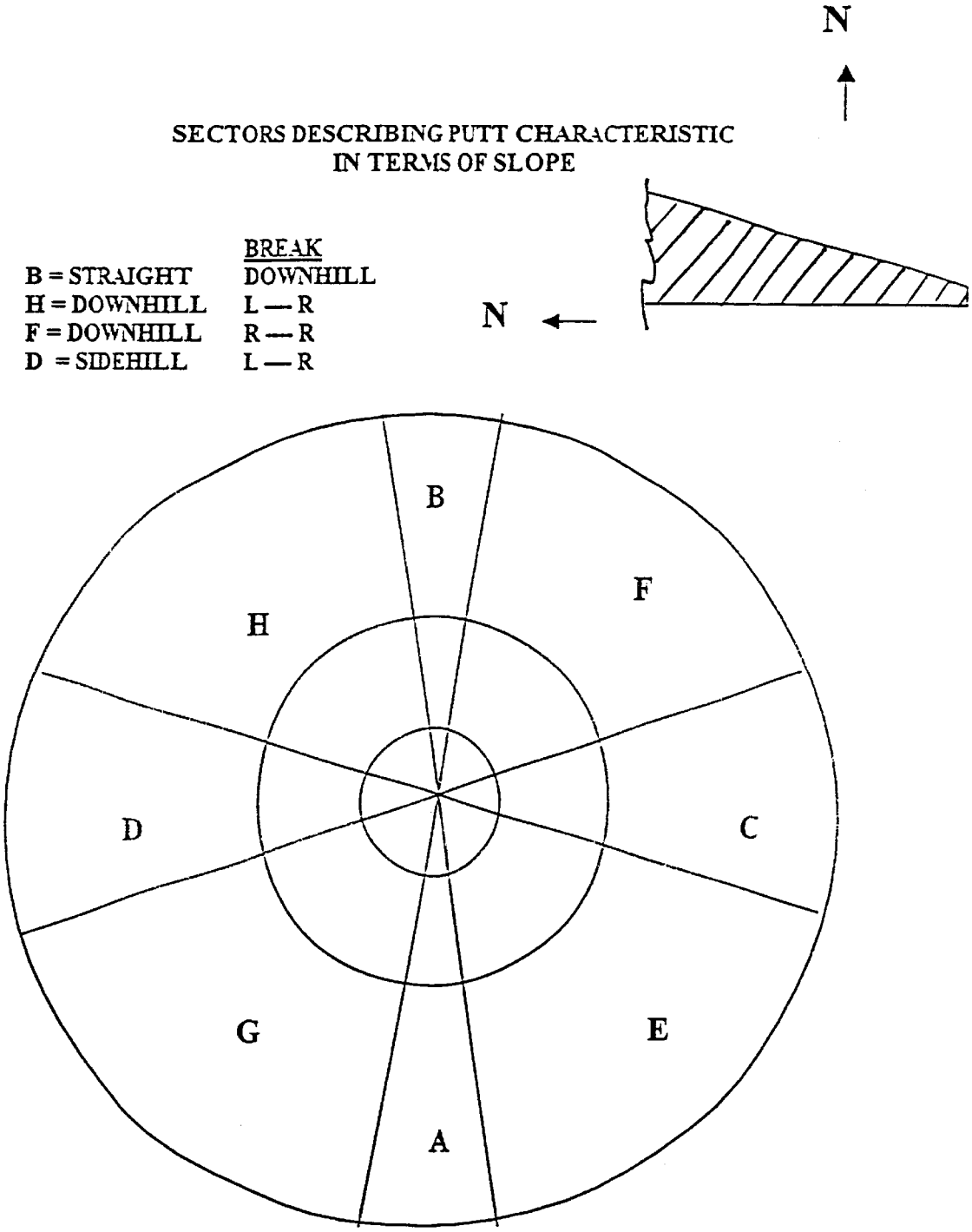
FIG. 6 is a chart illustrating the sectors describing the putt characteristics in terms of slope.
Figure 7:
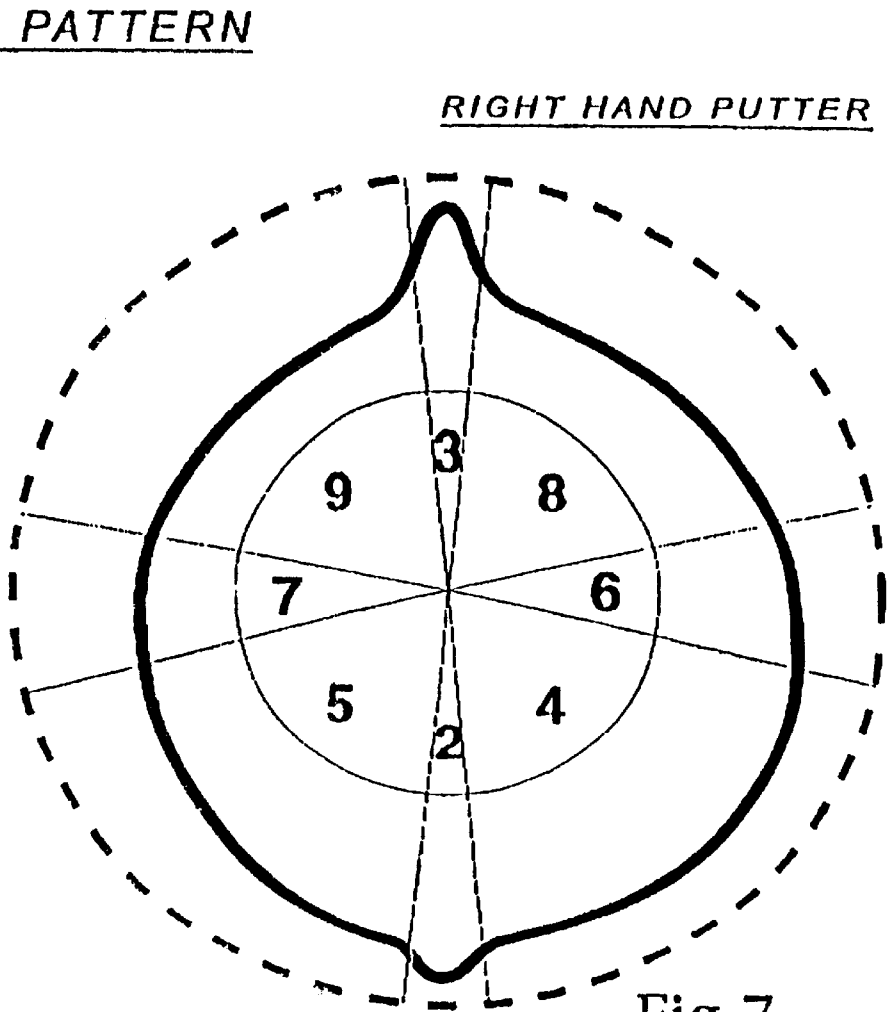
FIG. 7 is a chart illustrating the putting green weighing factors in a "lemon pattern".

Inherent Utility of the Invention and its Evidence-Based Statistical Criteria Reference is made to FIGS. 6 and 7 of the drawings.

It will be appreciated by those skilled in the art that the present invention provides the following:

(1) a putting reference frame or method of differentiating among the degree of difficulty different putts present;

(2) the components of a putt, the relative importance of these components, and how these components distribute influence on the difficulty of a putt;

(3) a statistically sound, useful, predictive model for an individual putt;

(4) a dynamic mathematically predictive model for a putting green with a plurality of conditions; and (5) an easily understood, daily pin placement sheet that is permitted by the U.S.G.A. Rules of Golf.

It is observed that the good golfer, on average, takes 36 putts to complete a round of golf on the typical course in very good condition. This number is based on par golf that allocates 2 putts per golf hole for a regulation score. This 36 stroke average per round serves as the reference for weighing each of the individual putt components listed below. This "Reference 36" is like ground zero; putts that are more difficult than average are allocated a value greater than 36, while easier putts are allocated a value of less than 36.

A round of golf includes a plurality of different positions and conditions on the eighteen putting greens. Several factors influence the likelihood that a specific putt will be holed in one, two, three or more strokes. These factors include:

a. The distance from the pin [in feet].

b. The putt characteristic defined by the relevant topography [12 characteristics].

c. The severity of the slope [gradient].

d. The putting green speed [stimpmeter reading].

e. The skill level of the player [putting handicap].

f. The overall condition of the putting green.

g. The type of grass and grain.

h. Other factors [ball balance, wind, etc.].

By careful observation and analysis, these individual components of a putt can be weighed as to their specific individual contribution to putt difficulty. These factors are assigned values based on statistics and these values are named the "*Putt Component Weighing Values*" (P.C.W.V.s). An evidence-based, statistically useful, stroke-per-round value is allocated to each of the individual putting components. This stroke value may be refined as more detailed research data is accumulated.

It is not possible to predict with certainty the outcome of any individual golf shot. However, from any position on the putting green, and by recognizing appropriately the putt component weighing values, the likelihood of completing the hole with one, two, three, or more strokes can be predicted within a statistically useful range or percentage confidence limit. The percentage confidence limits may vary depending upon the detail of the pictorial representation desired. However, for simplicity, a 75% confidence limit is useful. For example, at the point where a one putt would occur 75% of the time, and a two putt would occur 25% of the time, a 75% one putt Putting Confidence Line (P.C.L.) would be drawn.

Putting Confidence Lines that predict one, two, three or more putts may be derived by integrating the several P.C.W.V.s for any individual pin position on the putting green. The unique manner or radial pattern in which each P.C.W.V. exerts its influence on the daily pin position is characterized. Subsequently, each P.C.W.V.s relative importance is factored, and its complex interaction with other P.C.W.V.s is noted. Successive computer integration of this P.C.W.V. data or selected components of this data produces a mathematical description of the likely putting outcome from all ball positions on the green. The mathematical descriptions of these 75% P.C.L.s is then pictorially presented in an easily understood dynamic Putting Green Hazard Function (P.G.H.F.) pin placement diagram. This diagram of each green may be presented in a number of ways including a blending of colors where each color depicts a different level of difficulty.

Factor (a): Distance from the Pin (with reference to FIGS. 5–7)

Figure 5:
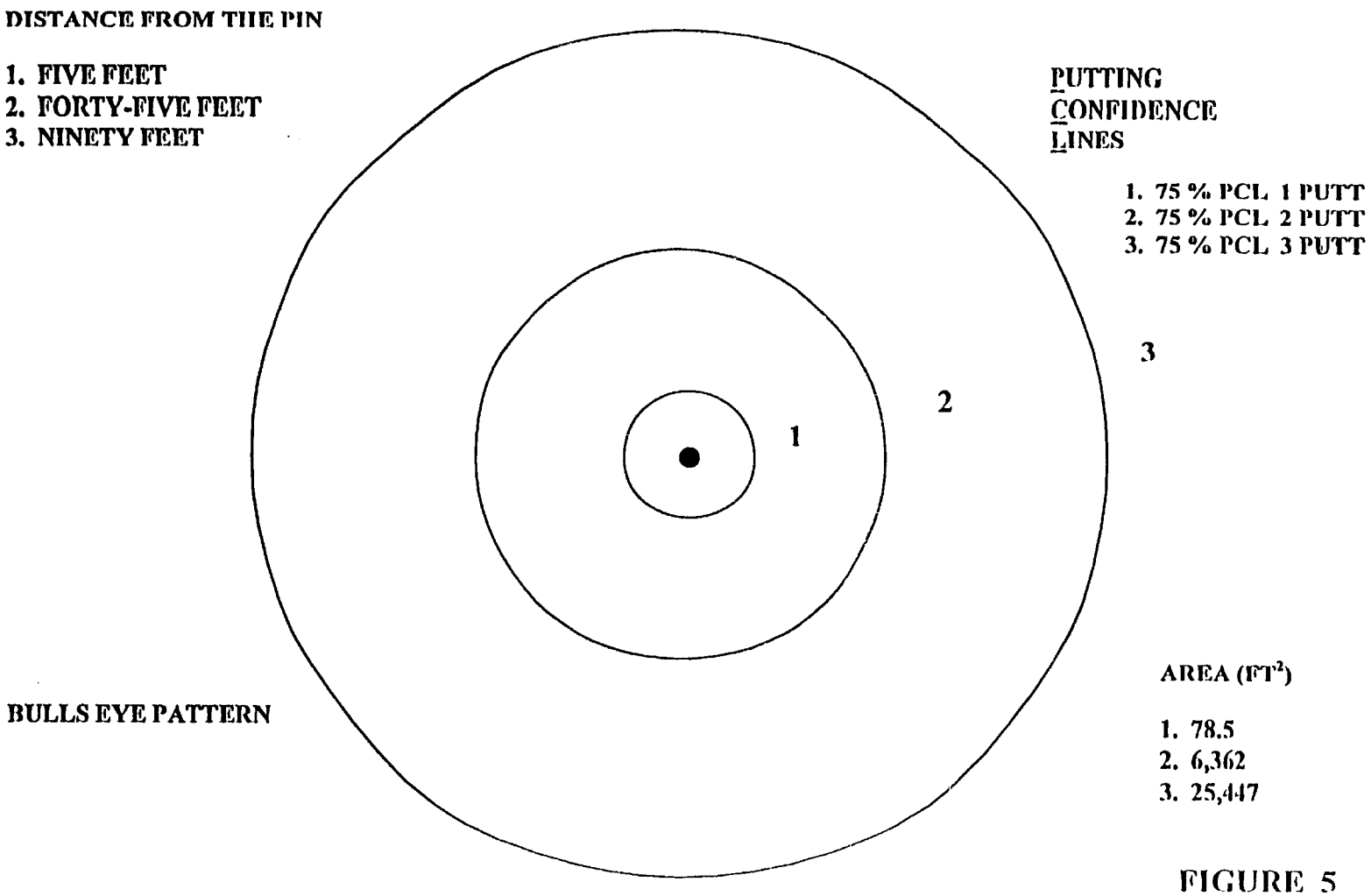
FIG. 5 is a chart illustrating the putting green weighing factors in a "bulls-eye pattern".

The closer the ball is to the pin the greater the likelihood of making the putt. For a good amateur golfer putting on a perfectly flat, perfectly conditioned, a stimpmeter reading of 10, putting green putts of 3 inches or less have a greater than 99% chance of being holed with one putt. The likelihood of one putting decreases as distance from the hole increases such that at 5 feet the probability is reduced to 75%. At 45 feet there is a 75% probability the good amateur golfer will two putt with a small chance, less than 2%, of one putting and approximately a 25% chance of three putting. At 90 feet there is a 75% probability of the good amateur golfer three putting with approximately a 25% probability of two putting and less than a 1% probability of one putting. FIG. 4 describes the effects distance alone has on a flat, stimpmeter 10, perfectly conditioned putting green. A 75% confidence line can be drawn at 5 ft. for one putt, 45 ft. for two putts, and 90 ft. for three putts. A further representation of this figure is by a Bulls-Eye Pattern as shown in FIG. 5.

Within the parameters described above it is reasonable to estimate that:

1. If all putts in a round of golf were 5 feet in length, the number of putts required to complete the round would be $[(18\times1)+(18\times0.25)]=22.5$. The likelihood of three putts is very small from this distance.

2. If all putts were 45 feet in length, the number of putts required would be $[(18\times2)+(18\times0.25)]=40.5$. The number of one putts and four putts are both small and offsetting.

3. If all putts were 90 ft. in length, the number of putts required would be $[(18\times3)-(18\times0.25)]=49.5$. Again, the number of one putts and four putts are approximately offsetting but a significant number, approaching 25%, are holed in 2 putts.

Therefore, the weighing value relating to distance only and distributed radially in a bulls-eye pattern up to 90 feet about the pin position is 49.5 strokes per round. This number is the Putt Component Weighing Value for distance (P.C.W.V.(a)). The statistics and formulas used to derive the weighing values may become more sophisticated as more detailed statistics become available and as more sophisticated diagrams are requested.

Any other P.C.W.V. increasing the degree of difficulty of the putt, will move the 75% confidence lines for one putting, two putting or three putting closer to the pin. Conversely any factor decreasing the difficulty of the putt will increase the distance from the pin to the 75% confidence lines. Unlike the distance weighting factor, the influence of several other P.C.W.V.s on the 75% P.C.L.s are not uniformily distributed in a radial bulls-eye pattern about the pin. Each P.G.W.F. describes its own unique series of 75% P.C.L.s.

Factor (by: Putt Characteristics (see FIG. 7)

Putting green topography significantly affects the roll of the golf ball and putting performance. The path of a putt may be generally described as having one of the following twelve putt characteristics:

| PUTT CHARACTERISTIC | STROKE DIFFICULTY ADDITIVE |
|---|---|
| 1. flat and straight | 0 |
| 2. straight uphill | 0.5 |
| 3. straight downhill | 1.0 |
| 4. uphill breaking right to left | 1.5 |
| 5. uphill breaking left to right | 2.0 |
| 6. sidehill breaking right to left | 2.5 |
| 7. sidehill breaking left to right | 3.0 |
| 8. downhill breaking right to left | 3.5 |
| 9. downhill breaking left to right | 4.0 |
| 10. complex breaking pattern overall flat | 4.5 |
| 11. complex breaking pattern uphill | 5.0 |
| 12. complex breaking pattern downhill | 5.5 |

The least complex putt is flat and straight (#1). A uniform north-south elevation change in a putting green produces changes in the roll of the golf ball such that eight other putt characteristics can be identified(#2–#9). Putting green topography often is such that a putt may have more than one break along its putting line to the hole. Therefore, three more descriptions are added for complex breaking putts (#10–#12).

Representation of a uniformly inclined putting green with a centrally located pin position according to the above putt characteristics produces a segmental diagram (FIG. 6). If in addition to a North to South elevation change, the putting green includes a similar East to West elevation change; and the straight downhill/uphill axis rotates anti-clockwise from North to South to North/West to South/East. The putt characteristics are similarly rotated, and their relationships are thereby preserved.

The specific characteristics of a putt contribute to its degree of difficulty and therefore to the distance of the 75% P.C.L. from the pin positions. The putt characteristics are listed in increasing degree of difficulty for a right-handed putter (mirror image for a left-handed putter). An additive of 0.5 strokes is allocated sequentially to each of the putt characteristics after straight and flat. Such that a #12 putt would increase the P.C.W.V. for putting characteristic by $[(0.5*(12-1))=5.5$ stokes per round. See above Table.

Therefore, on a uniformly North to South sloped putting green, the P.C.L.s reconfigure into a lemon shape (FIG. 6) rather than a bulls-eye pattern (FIG. 5). This change in the P.C.L.s occurs because putts in different segments have different levels of difficulty. For the Putting Characteristics Factor, the highest possible P.C.W.V.(b) is 5.5 strokes per round.

Factor (c): Severity of Topography

Increasing the severity of the topography increases the difficulty for putt characteristics #2 through #12 in a nonuniform but specific manner. The elevation change, or mean gradient, between the ball position and the pin position defines the severity of the topography. Increasingly severe topography affects downhill putts (#2,#8,#9,#12) and side-hill putts (#6,#7) more than uphill putts (#3,#4,#5,#11). Five categories of severity of topography are recognized between 0% and 15% grade. Increasingly severe topography has a logarithmic influence on Reference 36 as allocated in the table. According to these statistics, the severity of topography P.C.W.V. is 18 strokes per round.

| Slope in Degrees | 0–3 | 4–6 | 7–9 | 10–12 | 13–15 |
|---|---|---|---|---|---|
| P.C.W.V. | 0 | 3 | 7 | 12 | 18 |

Factor (d): Putting Green Speed

The faster the green, the greater sensitivity is required to avoid putting distance errors. The faster the green, the more break occurs given a constant slope. The routine standard of green speed is measured in feet by a stimpmeter reading. If the putting green is flat, the influence of increased putting green speed is distributed in a bulls-eye pattern. If other putt characteristics apply, increasing putting green speed influences the 75% P.C.L.s and, again, in a lemon-shaped pattern. Those already more difficult putts become more difficult, again influenced by their original degree of difficulty. With increasing speed, downhill putts become disproportionately more difficult with respect to both distance and break.

The optimal green speed is a stimpmeter reading of 9. Stimpmeter readings above or below 9 add to the degree of putting difficulty according to the following scale that is based on Reference 36.

| Stimpmeter Reading | Stroke Difficulty Additive |
|---|---|
| 7 | 1.0 |
| 8 | 0.5 |
| 9 | 0.0 |
| 10 | 1.0 |
| 11 | 2.0 |
| 12 | 4.0 |
| 13 | 6.0 |

Therefor based on these numbers, the green speed weighing value (PCWV) is 6 strokes per round.

Factor (e): Skill Level of the Player

Players can be sub-grouped according to their putting skills into poor, fair, good, very good and excellent. An observation based on Reference 36 is made of putts per round according to the following table:

| Skill Level | Reference 36 | Value |
|---|---|---|
| Poor | 39 | 3 |
| Fair | 37 | 1 |
| Good | 36 | 0 |
| Very Good | 34 | −2 |
| Excellent | 30 | −6 |

Better players handle difficult putting situations disproportionately better than less difficult situations. Therefor, the P.G.H.F. related to skill level follows a bulls-eye pattern for a flat green but a lemon-shaped pattern if other putt characteristics are involved.

Therefore, and based on these numbers, the skill level weighing value PCWV (e) is 9 strokes per round.

Factor (f): Overall Condition of Green

In keeping with Reference 36, the level of green conditioning can be characterized according to the following scale:

Very Poor=2, Poor=1, Average=½, Good=0, Very good=−½, Excellent=−1 The better the course condition the more predictable the roll of the golf ball and the grater the likelihood of the putt being holed. Conditioning is considered uniformly distributed throughout the green and throughout the course. The influence of conditioning is described as a bulls-eye pattern.

Therefore, and based on these numbers, the putting green conditioning value PCWV (f) is 3 strokes per round.

Factor (g): Grass Type and Grain

These factors are regional and site-specific. Weighing values may be allocated on an course-by-course basis. The PCWV (g) is "x" strokes per round Methodology Evaluating a Specific Putt and Generating a Color Picture The range for each of the P.C.W.V.s is listed below:

| Factor | Low | High |
|---|---|---|
| (a) Distance | 18 | 49.5 |
| (b) Putt Characteristics | 0 | 5.5 |
| (c) Severity of Topography | 0 | 18 |
| (d) Green Speed | 0 | 6 |
| (e) Skill Level | −6 | 3 |
| (f) Condition of Green | 0 | 3 |
| Total | 12 | 85 |

For any putt, each factor is evaluated and a weighing value is assigned for that value. Then the values for each factor are added together. This total is the Putting Green Hazard Score (P.G.H.S.) for any putt. Thus, the P.G.H.S.=(P.C.W.V.(a)+P.C.W.V.(b)+. . . ). Therefore, the formula to determine the P.G.H.F. for any particular point on the green is as follows:

P.G.H.F.=P.G.H.S./18=a number between 0 to 4 or more. For example, if the P.G.H.S. is 72, the P.G.H.F. shall be 4. This number represents the likely number of putts to hole out the ball. This number may then be presented in a diagram using different colors and lines to show the relative difficulty of each putt. For example, a one putt may be allocated the color green. For simplicity, P.G.H.F.s less than one are deemed to take one putt because even a tap in counts as a one putt. Putts over 4 are also lumped together so that the focus of the drawing can be on the range between 1 to 4 putts.

The putting green may be represented by a blended rainbow colored, bulls-eye based on distance from the daily pin placement. Configuration A The putting green is further described into segments by radial lines emanating from the daily pin placement. Configuration A1

The putt characteristic most representative of that segment at various distances from the pin is selected based upon the relevant topography.

The distance only bulls-eye blended rainbow representation is reconfigured according to the lemon pattern influence previous described.

Severity of the gradient is recognized according to a lemon pattern. Configuration C Green speed is recognized according either by a bulls-eye or lemon pattern. Configuration D The player's skill level is recognized by a bulls-eye or lemon pattern. Configuration E The over all condition of the green is accommodated in a bulls-eye pattern. Configuration F The type of grass and grain are recognized according to specific putting green data. Configuration G.

Other factors can be added. Configuration H

The final synthesis of this information is the Putting Green Hazard Function (P.G.H.F.).

Configuration I

The P.G.H.F. is depicted as an improved pin placement chart. This chart could include:

1. The 1,2,3,4 Putting Confidence Lines described about the daily pin position.

2. Monochromatic shading or cross-hatching to describe within the P.C.L.s the 1,2,3,4 putt areas on the putting green.

3. A multi-colored representation of the monochromatic chart described in #2.

4. A rainbow colored representation of such colored areas with blended color representing statistical transitions.

5. A blended color representation superimposed on a topographical contour map of the putting green.

By providing the internet server, the confidentiality of the proprietary data and algorithms are maintained, and color copying of print-out charts is avoided. Using readily available technology, the displays on the "PALM PILOT" (or its equivalent) would be provided to the player at a very reasonable fee per round.

It will be appreciated by those skilled in the art that the present invention has achieved its objectives by providing a comprehensive, evidence-based complex, standardized statistical analysis that generates a user-friendly, color-coded display (monitor, chart, or diagram) that is quickly changed to reflect changing green conditions and, particularly, the pin location 18. The pin location 18 is the most important factor; and to a certain extent, the other green conditions 19–26 (except for the handicap or skill of the player 21) are inter-related to the pin location 18 and are a function thereof.

Obviously, many modifications may be made without departing from the basic spirit of the present invention. For example, the degree of detail and sophistication can be varied; e.g., the player's ability need not be included to individually tailor the chart. Rather, an average performance index could be entered and applied to all charts printed or displayed that day. In addition, the statistical information may be improved at any time. Accordingly, it will be appreciated by those skilled in the art that within the scope of the appended claims, the invention may be practiced other than has been specifically described herein.

What is claimed is:

1. In the game of golf, wherein a course includes a plurality of putting greens, each of which is provided with a pin indicating the hole location on the respective green, and wherein the local conditions on each green including the pin location are changed from time to time, the improvement in planning the approach shot to the green so as to minimize the number of putts required when on the green following the approach shot, comprising a dynamic user-friendly color-coded display for each green, the display indicating, at least, the relative danger zone on the green and taking into account changes in a plurality of the local conditions of the green including any daily changes in the pin location, thereby substantially improving the approach shots and hence minimizing the required number of putts and improving one's overall golf game.

2. The improvement of claim 1, wherein the relative danger zone comprises an extreme danger zone.

3. The improvement of claim 2, wherein an optimal zone is included in the color-coded display.

4. The inprovement of claim 3, wherein the pin location is within optimal zone.

5. The improvement of claim 4, wherein a regulation zone is included between the optimal and danger zones.

6. The improvement of claim 1, further including a computer apparatus for providing the color-coded display, the pin location and/or the daily local conditions being inputted to the computer apparatus.

7. The improvement of claim 6, further including the distance to the cup being inputted to the computer apparatus.

8. The improvement of claim 7, further including the putt characteristics being inputted to the computer apparatus.

9. The improvement of claim 8, further including the contour of the green being inputted to the computer apparatus.

10. The improvement of claim 9, further including the green speed being inputted to the computer apparatus.

11. The improvement of claim 10, further including the level of skill of the player being inputted to the computer apparatus.

12. The improvement of claim 11, further including the overall green condition being inputted to the computer apparatus.

13. The improvement of claim 12, further including the green type and grain being inputted to the computer apparatus.

14. The improvement of claim 13, further including other factors, such as wetness, being inputted to the computer apparatus.

15. In the game of golf, wherein a course includes a plurality of putting greens, each of which has a particular topography, and each of which is provided with a pin indicating the hole location on the respective putting green, and wherein at least the pin location is changed from time to time, the improvement in planning the approach shot to each green so as to minimize the number of putts required when on the green following the approach shot, comprising a new pin placement display including confidence lines, monochromatic colors or blended colors superimposed on the topography of the respective putting greens, the color-coded displays indicating a danger, a regulation and an optimal zone for the respective putting greens, thereby substantially improving the approach shots and hence minimizing the number of required putts and improving one's overall golf game.

16. The method of playing a game of golf, wherein a course includes a plurality of putting greens, each of which is provided with a pin indicating the hole location on the respective green, and wherein the pin location is changed from time to time, the improvement in planning the approach shot to the green so as to minimize the number of putts required when on the green following the approach shot, comprising the step of providing a new color-coded display for each green whenever the pin locations are changed on the respective greens, thereby substantially improving the approach shots and hence minimizing the required putts and improving one's overall golf game, and wherein the color-coded display includes a danger zone for the respective greens.

17. The improvement of claim 15, further including the step of providing an extreme danger zone.

18. The improvement of claim 15, further including the step of providing an optimal zone.

19. The improvement of claim 18, wherein the pin location is within the optimal zone.

20. The improvement of claim 19, further including the step of providing a regulation zone between the respective optimal and danger zones.

21. The improvement of claim 16, further including the step of providing a computer apparatus for printing out the color-coded displays, the pin locations being inputted to the computer apparatus.

22. The improvement of claim 21, wherein the distances to the cup are inputted to the computer apparatus in addition to the pin location.

23. The improvement of claim 22, wherein the putt characteristics are inputted to the computer apparatus.

24. The improvement of claim 23, wherein the contour of the green is inputted to the computer apparatus.

25. The improvement of claim 24, wherein the green zone is inputted to the computer apparatus.

26. The improvement of claim 25, wherein the skill level of the player is inputted to the computer apparatus.

27. The improvement of claim 26, wherein the overall green condition is inputted to the computer apparatus.

28. The improvement of claim 27, wherein the grass type and grain is inputted to the computer apparatus.

29. The improvement of claim 27, wherein other factors such as wetness, is inputted to the computer apparatus.

30. In the game of golf, the combination of a computerized apparatus for assigning respective weighing factors to the pin locations and to the other greens conditions pertaining to the greens on a golf course, means for inputting the pin locations and the greens conditions to the computerized apparat, and means responsive to the computerized apparatus for producing a color-coded display for the respective greens, the color-coded display including optimal, regulation and danger zones on the respective greens, thereby facilitating improved approach shots to the greens, and thereby minimizing-the required putts following the respective approach shots and improving one's-overall golf game.

31. The combination of claim 30, wherein the color-coded display further includes an extreme zone.

32. The combination of claim 30, wherein the color-coded display comprises a print-out sheet.

33. The combination of claim 30, wherein changing pin locations are inputted to the apparatus, thereby changing the color-coded displays.

34. The combination of claim 33, wherein the distances to the pin are inputted to the apparatus.

35. The combination of claim 30, wherein one or more of the following factors are inputted to the apparatus: putt characteristic, contour of the green, green zone, skill level of the player, overall green condition, and the grass type and grain.

36. The combination of claim 30, wherein the color-coded display comprises a video display.

37. The combination of claim 36, wherein the video is broadcast to a TV audience.

38. In the method of playing the game of golf, the improvement in planning and executing the approach shots to the respective greens so as to minimize the number of putts required when on the respective greens following the approach shots, comprising the step of providing an evidence-based statistically-sound color-coded user-friendly hand-held display for the respective greens on the golf course, the display being provided by an internet server via a wireless communication link to the hand-held display, and the display changing in accordance with changing conditions on the respective greens, thereby improving the approach shots to the respective greens, minimizing the total putts on the greens, and improving one's overall golf game.

39. The improvement of claim 38, wherein the changing conditions comprise the changing pin locations on the respective greens.

40. The improvements of claim 38, wherein the color-coded display comprises optimal, regulation and danger zones, respectively, and wherein the colors chosen for the respective zones have hues which change in intensity towards the respective adjacent zones, such that the colors blend together as in a rainbow.

41. A color-coded display for a putting green on a golf course, comprising optimal, regulation and danger zones, respectively, each of which is denoted by a respective color.

42. The color-coded display of claim 41, wherein the optimal, regulation and danger zones are denoted by green, yellow and red, respectively.

43. The color coded display of claim 42, further including an extreme danger zone denoted by a dark red color.

44. The color-coded display of claim 41, wherein the respective colors blend into each other at adjacent zones.

45. The color-coded display of claim 41, wherein the respective zones change in accordance with changes in the pin location.

46. The color-coded display of claim 41, wherein the display is superimposed on the topography of the green.

47. A color-coded display for a putting green on a golf course, the purpose of which is to plan and execute the approach shots to the respective greens so as to minimize the number of required putts when on the respective greens following the approach shots, comprising optimal, regulation and danger zones, respectively, denoted by green, yellow and red, respectively, and further including an extreme danger zone denoted by a dark red color, wherein the respective colors blend into each other at adjacent zones, wherein the respective zones change in accordance with changes in pin location, and wherein the display is superimposed on the topography of the green, thereby substantially improving the approach shots, minimizing the required putts, and improving one's overall golf game.

48. A color-coded display for a putting green on a golf course, the display including at least a anger zone shown in a particular color as a portion of the putting green, and the purpose of the display improving the approach shot to the green and thereby minimizing the number of required putts when on the green.

49. The color-coded display of claim 48, wherein the danger zone is shown in red.

50. The color-coded display of claim 49, further including an extreme danger zone which is shown in dark red.

51. In combination with a simulated golf game or golf video game, a color-coded display for the putting green.

52. The combination of claim 51, wherein said display changes in accordance with changing conditions on the green.

53. In the process for the architectural design of a golf course, the improvement comprising the step of superimposing a color-coded display on the theoretical topography of a putting green and making any desirable changes in the architecture of the green, the superimposed color-coded display including danger, regulation and optimal zones, respectively, each of which has a distinctive color, and the colors tending to blend in with one another as in a rainbow, thereby avoiding costly revisions once the green has been constructed.

54. The improvement of claim 15, further including an extreme danger zone.

55. The-method of improving the playing of golf, and in particular, targeting the best shot to stop the ball on each respective putting green with the objective of reducing the number of subsequent putts to-hole out on the green, comprising the steps of identifying a plurality of respective conditions pertaining to each putting green, making an evidence-based statistically-sound analysis to assign respective weighing factors to each of these conditions, organizing each green into respective zones indicative of the relative difficulty of holing out, and providing a dynamic user-friendly display of these respective zones for the benefit of the golfer playing the game, the respective zones on the display changing as the respective conditions change on the greens.

56. The method of claim 55, wherein each zone comprises optimal, regulation and danger zones.

57. The method of claim 56, wherein the display is color coded and includes green for the optimal zone, yellow for the regulation zone, and red for the danger zone.

58. The method of claim 57, further including an extreme danger zone colored in dark red.

59. The method of claim 58, wherein the colors tend to blend into one another as in a rainbow.

60. The method of claim 55, wherein the display comprises a chart.

61. The method of claim 55, the display comprises a video presentation.

* * * * *

UNITED STATES PATENT AND TRADEMARK OFFICE

CERTIFICATE OF CORRECTION

PATENT NO. : 6,592,473 B2
DATED : July 15, 2003
INVENTOR(S) : McDonald et al.

It is certified that error appears in the above-identified patent and that said Letters Patent is hereby corrected as shown below:

Drawings,
Substitute black and white Sheet 3 of 8 for present colored Sheet 3 of 8.
Re-number colored Sheet 3 of 8 to become Sheet 4 of 8.
Delete black and white Sheet 4 of 8.

Signed and Sealed this

Twentieth Day of April, 2004

JON W. DUDAS
*Acting Director of the United States Patent and Trademark Office*